US009158219B2

(12) United States Patent
Kojiri

(10) Patent No.: US 9,158,219 B2
(45) Date of Patent: Oct. 13, 2015

(54) IMAGE FORMING APPARATUS CHANGING A FIXING PRESSURE AND IMAGE FORMING METHOD THEREOF

(71) Applicant: FUJI XEROX CO., LTD., Tokyo (JP)

(72) Inventor: Tetsunao Kojiri, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 19 days.

(21) Appl. No.: 13/772,809

(22) Filed: Feb. 21, 2013

(65) Prior Publication Data

US 2014/0029966 A1 Jan. 30, 2014

(30) Foreign Application Priority Data

Jul. 24, 2012 (JP) ..... 2012-163310

(51) Int. Cl.

*G03G 15/20* (2006.01)
*G03G 13/22* (2006.01)
*G03G 15/00* (2006.01)

(52) U.S. Cl.

CPC ..... *G03G 13/22* (2013.01); *G03G 15/2064* (2013.01); *G03G 15/6585* (2013.01); *G03G 2215/2009* (2013.01); *G03G 2215/2032* (2013.01)

(58) Field of Classification Search

CPC ..... G03G 13/22; G03G 15/2064; G03G 15/6585; G03G 2215/2009; G03G 2215/2032
USPC ..... 399/67, 328, 331, 401
See application file for complete search history.

(56) References Cited

U.S. PATENT DOCUMENTS

| | | | |
|---|---|---|---|
| 5,910,388 | A * | 6/1999 | Ray et al. |
| 2011/0117487 | A1* | 5/2011 | Shifley et al. |
| 2011/0236043 | A1* | 9/2011 | Masui |
| 2012/0063819 | A1* | 3/2012 | Kasai et al. |
| 2012/0106999 | A1 | 5/2012 | Sonoda et al. |

FOREIGN PATENT DOCUMENTS

| | | | |
|---|---|---|---|
| JP | A-1-179184 | | 7/1989 |
| JP | A-6-250478 | | 9/1994 |
| JP | 2003015461 | A * | 1/2003 |
| JP | A-2004-29194 | | 1/2004 |
| JP | A-2004-233421 | | 8/2004 |

OTHER PUBLICATIONS

Nov. 29, 2013 Australian Search Report issued in Australian Application No. 2013201906.

(Continued)

*Primary Examiner* — Susan Lee
(74) *Attorney, Agent, or Firm* — Oliff PLC

(57) ABSTRACT

There is provided an image forming apparatus including an image forming section that forms a toner image on a printing medium by using plural toners including a particular toner, a fixing section that fixes the toner image which is formed on the printing medium by the image forming section, a retransporting section that transports the printing medium to the image forming section again in a state where a surface of the printing medium is the same, and a changing section that changes a fixing pressure at the time of fixing the toner image, in which the particular toner is used, and at the time of fixing the toner image, in which the toners other than the particular toner are used, when the toner image is formed on the printing medium by the image forming section and the toner image is fixed by the fixing section plural times.

10 Claims, 7 Drawing Sheets

(56) References Cited

OTHER PUBLICATIONS

Sep. 30, 2014 Office Action issued in AU Application No. 2013201906.

Feb. 2, 2015 Office Action issued in Australian Application No. 2014200724.

Mar. 18, 2015 Office Action issued in Australian Application No. 2013201906.

* cited by examiner

IMAGE FORMING APPARATUS CHANGING A FIXING PRESSURE AND IMAGE FORMING METHOD THEREOF

CROSS-REFERENCE TO RELATED APPLICATIONS

This application is based on and claims priority under 35 USC 119 from Japanese Patent Application No. 2012-163310 filed Jul. 24, 2012.

BACKGROUND (i) Technical Field

The present invention relates to an image forming apparatus and an image forming method.

(ii) Related Art

In the related art, as the image forming apparatus, for example, image forming apparatuses are proposed in advance.

SUMMARY

According to an aspect of the invention, there is provided an image forming apparatus including: an image forming section that forms a toner image on a printing medium by using plural toners including a particular toner of which at least one of each particle diameter and each particle shape is different from that of other toners; a fixing section that fixes the toner image which is formed on the printing medium by the image forming section; a retransporting section that transports the printing medium, on which the toner image is fixed by the fixing section, to the image forming section again in a state where a surface of the printing medium is the same; and a changing section that changes a fixing pressure at the time of fixing the toner image, in which the particular toner is used, and at the time of fixing the toner image, in which the toners other than the particular toner are used, when the toner image is formed on the printing medium by the image forming section and the toner image is fixed by the fixing section plural times.

According to another aspect of the invention, there is provided an image forming apparatus including: an image forming section that forms a toner image on a printing medium by using a first set of toners including a particular toner containing pigment; and a fixing section that fixes, using the first set of toners, the toner image which is formed on the printing medium by the image forming section, and thereafter, that separately fixes the toner image using a toner different from the first set of toners on the printing medium, wherein a first predetermined fixing condition under which the toner image is fixed using the particular toner is different from a second predetermined fixing condition under which the toner image is fixed using toners other than the particular toner so that the fixing using the particular toner is fixed on the same portion of the printing medium separately from when the toner that is different from the first set of toners is fixed to the printing medium.

BRIEF DESCRIPTION OF THE DRAWINGS

Exemplary embodiments of the present invention will be described in detail based on the following figures, wherein.

DETAILED DESCRIPTION

Hereinafter, the best mode for carrying out the invention (hereinafter referred to as an "exemplary embodiment") will be described with reference to the accompanying drawings.

Exemplary Embodiment 1

Figure 1:
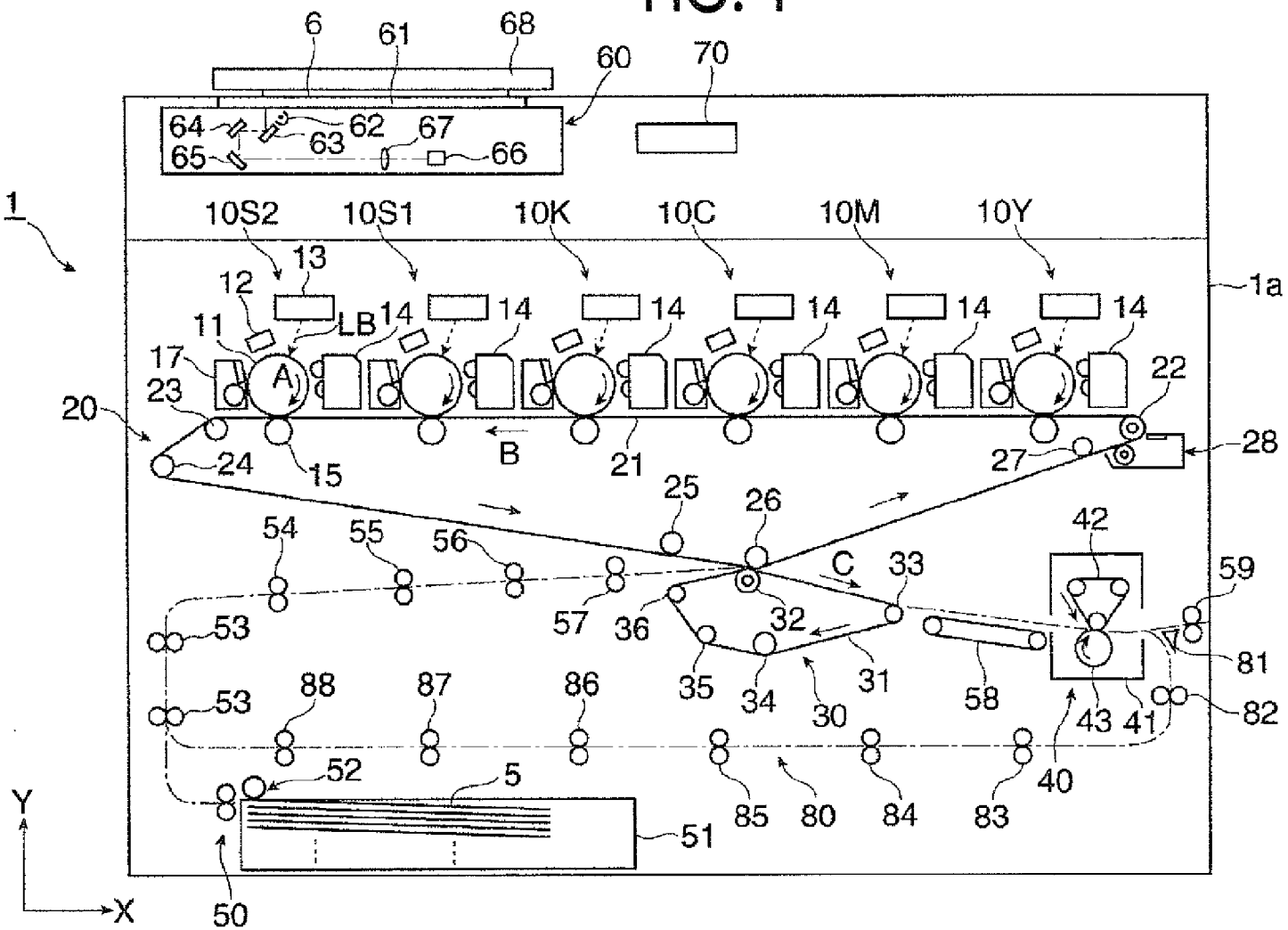
FIG. 1 is an overall configuration diagram illustrating an image forming apparatus according to Exemplary Embodiment 1 of the invention.
Figure 2:
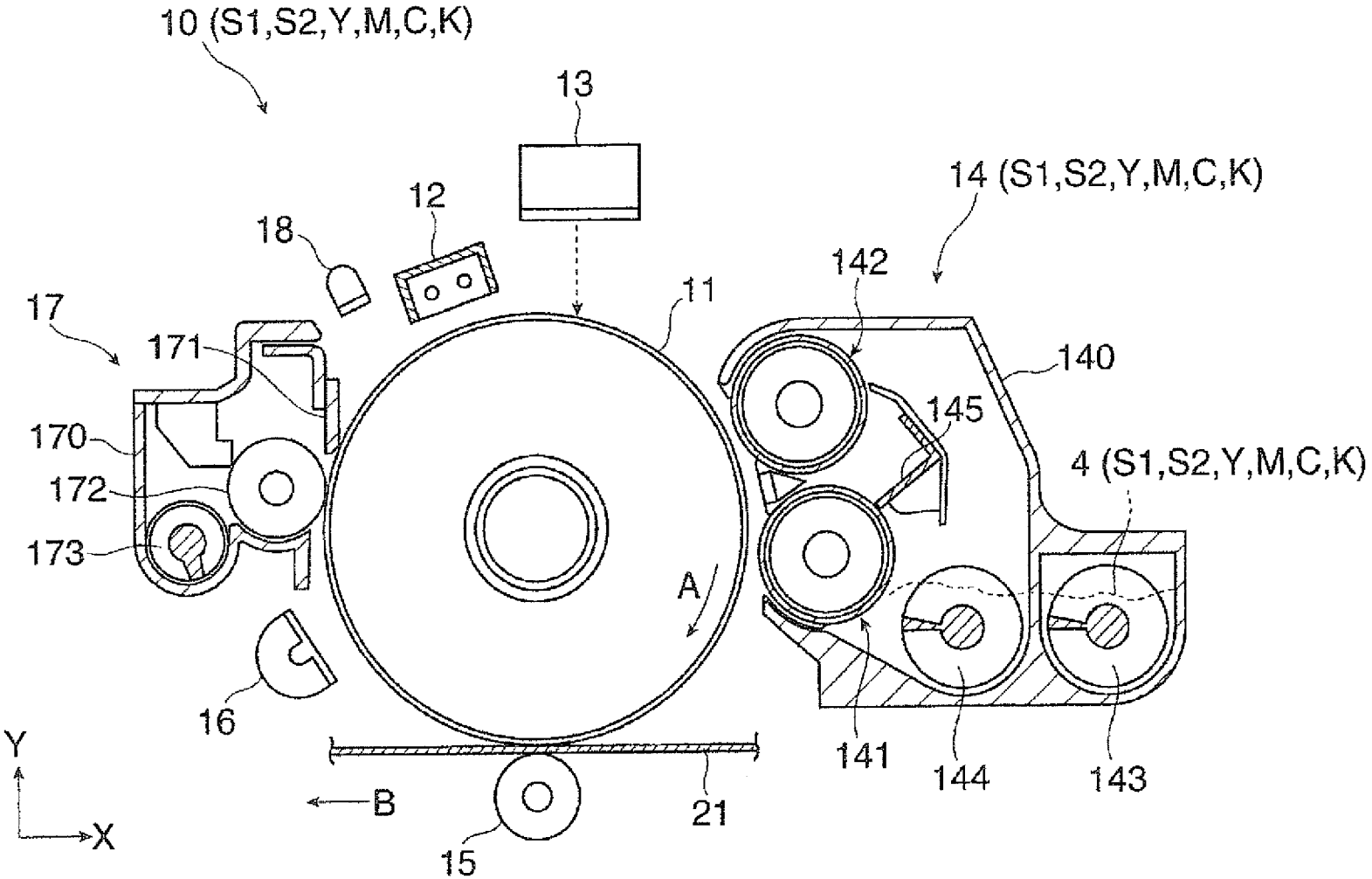
FIG. 2 is a configuration diagram illustrating principal sections of the image forming apparatus according to Exemplary Embodiment 1 of the invention.

FIGS. 1 and 2 show an image forming apparatus according to Exemplary Embodiment 1. FIG. 1 shows a brief overview of the entirety of the image forming apparatus. FIG. 2 shows principal sections (an image creating device and the like) of the image forming apparatus.

Overall Configuration of Image Forming Apparatus

The image forming apparatus 1 according to Exemplary Embodiment 1 is formed as, for example, a color printer. The image forming apparatus 1 includes: plural image creating devices 10 that forms a toner image, which is developed by a toner constituting a developer 4; an intermediate transfer device 20 that holds toner images respectively formed on the image creating devices 10 and transports the toner images to a secondary transfer position where secondary transfer of the images onto a printing paper 5 as an example of a printing target member is finally performed; a sheet feeding device 50 that contains and transports the desired printing paper 5 to be supplied to a secondary transfer section of the intermediate transfer device 20; a fixing device 40 that fixes the toner images secondarily transferred onto the printing paper 5 by the intermediate transfer device 20; and the like.

The image forming apparatus 1 can be formed as, for example, a color copier when the apparatus is additionally equipped with an image input device 60 that inputs an original image to be formed on the printing paper 5. The reference number 1*a* of the drawing indicates a casing of the image forming apparatus, and the casing 1*a* is formed of a supporting member, an exterior cover, and the like. Further, the chain line in the drawing indicates a principal transport path along which the printing paper 5 is transported in the casing 1*a*.

Configuration of Principal Sections of Image Forming Apparatus

The image creating devices 10 are formed of six image creating devices 10Y, 10M, 10C, 10K, 10S1, and 10S2 which form toner images with four colors of yellow (Y), magenta (M), cyan (C), and black (K) and two types of toner images with special colors S1 and S2 respectively dedicated therefor. The six image creating devices 10 (S1, S2, Y, M, C, K) are arranged in line in the inner space of the casing 1*a*. For example, developers with colors for which it is difficult or not possible to be represented by the four colors are used as the developers 4 (S1, S2) with the special colors (S1, S2). Specifically, the developers include toners with colors other than the four colors, toners which have the same colors as some of the four-color toners but different color saturations, transparent toners which increase the gloss levels thereof, foamable toners for point system, fluorescent color toners, and the like. Further, each image creating device 10 (S1, S2, Y, M, C, K) has a substantially common configuration shown as follows, except that the type of the pertinent developer 4 is different.

Each image creating device 10 (S1, S2, Y, M, C, K) includes a rotatable photoconductor drum 11 as shown in FIGS. 1 and 2. Thus, the following devices are principally disposed around the photoconductor drum 11. The principal devices includes: a charging device 12 that charges the circumferential surface (image holding surface), on which the image of the photoconductor drum 11 can be formed, at a desired electric potential; an exposure device 13 that forms the electrostatic latent image (for each color) with a potential difference by irradiating the circumferential surface, which is charged by the photoconductor drum 11, with light LB based on the information (signal) of the image; a developing device 14 (S1, S2, Y, M, C, K) that develops the electrostatic latent image into a toner image with a toner of the developer 4 of the corresponding color (S1, S2, Y, M, C, K); a primary transfer device 15 that transfers the toner image onto (the intermediate transfer belt of) the intermediate transfer device 20; an uncleaned-state charging device 16 that charges attachments such as the toner which remains on and is adhered onto the image holding surface of the photoconductor drum 11 after the primary transfer; a drum cleaning device 17 that cleans to remove the recharged attachments; a charge remover 18 that removes electric charge from the image holding surface after cleaning of the photoconductor drum 11; and the like.

The photoconductor drum 11 is formed by the image holding surface that has a photoconductive layer (photosensitive layer) made of a photosensitive material on the circumferential surface of the grounded substrate having a substantially cylindrical or columnar shape. The photoconductor drum 11 is supported to be rotatable in a direction indicated by the arrow A through power transferred from a rotation driving device which is not shown.

The charging device 12 is formed as a non-contact-type charging device such as a corona discharger which is disposed to not be in contact with the photoconductor drum 11. Such a discharging member of the charging device 12 is supplied with a charging voltage. When the developing device 14 performs reversal development with the charging voltage, a voltage or current with a polarity the same as the charge polarity of the toner supplied from the developing device 14 is supplied.

The exposure device 13 irradiates the charged circumferential surface of the photoconductor drum 11 with light LB (the dotted line to which the arrow is attached) which is generated on the basis of the information of the image input to the image forming apparatus 1, thereby forming an electrostatic latent image. The exposure device 13 receives image information (signal) which is input to the image forming apparatus 1 by an arbitrary section at the time of forming the latent image.

Any one of the developing devices 14 (S1, S2, Y, M, C, K) includes, as shown in FIG. 2: two developing rollers 141 and 142 that transport the developer 4 to two development regions, which face the photoconductor drum 11 at two positions, while holding the developer 4 inside a casing 140 in which an opening portion and a containing space of the developer 4 are formed; stirring transport members 143 and 144 such as two screw augers that stir and transport the developer 4 such that the developer passes the developing roller 142; a layer thickness regulation member 145 that regulates the amount (layer thickness) of the developer held on the developing roller 142; and the like. In the developing device 14, a developing voltage is supplied between the photoconductor drum 11 and the developing rollers 141 and 142 from a power supply device which is not shown. Further, the developing rollers 141 and 142 or the stirring transport members 143 and 144 are rotated in desired directions by the power transferred from the rotation driving devices which are not shown. Furthermore, two-component developers including non-magnetic toners and magnetic carriers are used as the four color developers 4 (Y, M, C, K) and the two special color developers 4 (S1, S2).

The primary transfer device 15 is a contact-type transfer device that has a primary transfer roller which is rotated in contact with the circumferential surface of the photoconductor drum 11 and is supplied with a primary transfer voltage. As the primary transfer voltage, a direct-current voltage, which has a polarity inverse to a polarity of the charge of the toner, or the like is applied from a power supply section for transfer which is not shown.

The drum cleaning device 17 includes, as shown in FIG. 2: a main member 170 that has a container shape of which a part is open; a cleaning plate (cleaning blade) 171 that is disposed to come into contact with the circumferential surface of the photoconductor drum 11 after the primary transfer with a desired pressure and removes attachments such as a remaining toner and performs cleaning; a rotatable brush roller 172 that is disposed to be rotatable in contact with the circumferential surface of the photoconductor drum on the upstream side of the cleaning plate 171 in the rotation direction of the photoconductor drum 11; a delivery member 173 such as a screw auger that is driven to collect the attachments such as the toner removed by the cleaning plate 171 and sent the attachments to a collecting system which is not shown; and the like. As the cleaning plate 171, a plate-like member (for example, blade) made of rubber and the like is used.

The intermediate transfer device 20 is disposed under the respective image creating devices 10 (S1, S2, Y, M, C, K), as shown in FIG. 1. The intermediate transfer device 20 principally includes: an intermediate transfer belt 21 that is rotated in a direction indicated by the arrow B while passing a primary transfer position located between the photoconductor drum 11 and the primary transfer device 15 (primary transfer roller); plural belt supporting rollers 22 to 27 that hold and rotatably support the intermediate transfer belt 21 in a desired state at the inside thereof; a secondary transfer device 30 that is disposed on the outer circumferential surface (image holding surface) side of the intermediate transfer belt 21, which is supported by a belt supporting roller 26, and secondarily transfers the toner image on the intermediate transfer belt 21 onto a printing paper 5; and a belt cleaning device 28 that removes and cleans the attachments such as paper powder and the toner which remains and is adhered onto the outer circumferential surface of the intermediate transfer belt 21 after passing the secondary transfer device 30.

The intermediate transfer belt 21 employs, for example, an endless belt made of a material which is formed by distributing resistance modifiers such as carbon black in a synthetic resin such as a polyimide resin and a polyamide resin. Further, the belt supporting roller 22 is formed as a driving roller, the belt supporting roller 23, 25, and 27 are formed as driven rollers that hold the running positions of the intermediate transfer belt 21, the belt supporting roller 24 is formed as a tensioning roller, and the belt supporting roller 26 is formed as a backup roller of the secondary transfer.

The secondary transfer device 30 includes, as shown in FIG. 1: a secondary transfer belt 31 that is rotated in a direction indicated by the arrow C while passing the secondary transfer position which is a portion on the outer circumferential surface of the intermediate transfer belt 31 supported by the belt supporting roller 26 in the intermediate transfer device 20; and plural supporting rollers 32 to 36 that hold and rotatably support the secondary transfer belt 31 in a desired state at the inside thereof. The secondary transfer belt 31 employs, for example, an endless belt which has substantially the same configuration as the above-mentioned intermediate transfer belt 21. The belt supporting roller 32 is disposed to tightly press the secondary transfer belt 31 toward the outer circumferential surface of the intermediate transfer belt 21 which is supported by the belt supporting roller 26 with a predetermined pressure. The belt supporting roller 32 is formed as a driving roller, and the belt supporting roller 36 is formed as a tensioning roller. Further, the belt supporting roller 32 of the secondary transfer device 30 or the supporting roller 26 of the intermediate transfer device 20 is supplied with a direct-current voltage, which has a polarity opposite to or the same as the charge polarity of the toner, as a voltage for secondary transfer.

The fixing device 40 includes, inside a casing 41 on which openings for feeding and discharging the printing paper 5 are formed: a heating rotating member 42 that is rotated in a direction indicated by the arrow and has a fixing belt heated by a heating section such that the surface temperature thereof is held at a predetermined temperature; and a pressing rotating member 43 that is driven to be rotatable in contact with the heating rotating member 42 along the substantially axial direction thereof with a predetermined pressure and has a drum shape. In the fixing device 40, the contact portion, in which the heating rotating member 42 and the pressing rotating member 43 come into contact with each other, is formed as a fixing processing section that performs a desired fixing process (heating and pressing).

The sheet feeding device 50 is disposed to be located under the intermediate transfer device 20 and the secondary transfer device 30. The sheet feeding device 50 principally includes a single (or plural) paper containing member 51 that contains and stacks the sheets of printing paper 5 with a desired size, a type, and the like; and a delivery device 52 that delivers the sheets of printing paper 5 from the paper containing member 51 one by one. The paper containing member 51 is mounted, for example, such that it can be taken out to the front side (the side facing an operator in use) of the casing 1*a*.

A sheet feeding transport path is provided between the sheet feeding device 50 and the secondary transfer device 30. The sheet feeding transport path is constituted by a transport guide member not shown in the drawing and plural pairs of paper transport rollers 53 to 57 transporting the printing paper 5, which is delivered from the sheet feeding device 50, to the secondary transfer position. The pair of paper transport rollers 57, which is disposed at a position just ahead of the secondary transfer position of the sheet feeding transport path, is formed as, for example, rollers (registration rollers) that adjust the timing of transporting the printing paper 5. Further, a paper transporting device 58 having a belt shape or the like for transporting the printing paper 5, which is delivered from the secondary transfer belt 31 of the secondary transfer device 30 after the secondary transfer, to the fixing device 40 is provided between the secondary transfer device 30 and the fixing device 40. Furthermore, a pair of paper discharging rollers 59 for discharging the printing paper 5, which is delivered from the fixing device 40 after the fixing, to the outside of the casing 1*a* is provided at a portion close to the opening for discharging the paper formed on the casing 1*a*.

In addition, the image input device 60, which is equipped in a case of the configuration of the above-mentioned color copier, is an image reading device that reads the original image having image information of the printing target, and is disposed on, for example, the upper side of the casing 1*a* as shown in FIG. 1. The image input device 60 principally includes: an original document loading plate (platen glass) 61 that is formed of a transparent glass plate and the like on which an original document 6 having information of an image to be read is loaded; a light source 62 that illuminates the original document 6, which is set on the original document loading plate 61, while moving the document; a reflection mirror 63 that receives the light reflected from the original document 6 while moving together with the light source 62 and reflects the light in a predetermined direction; a first reflection mirror 64 and a second reflection mirror 65 that move by a predetermined distance at a predetermined speed relative to the reflection mirror 63; an image reading element 66 that is formed of a CCD, which receives and reads the light reflected from the original document 6 and converts the light into an electric signal, and the like; an imaging lens 67 that images the reflected light on the image reading element 66; and the like. The reference number 68 of FIG. 1 is an access cover that covers the original document loading plate 61.

Further, image information of the original document, which is read and input by the image input device 60, is performed through the desired image processing by an image processing device 70. First, in the image input device 60, the image information of the read original document is transmitted as three color image data (for example, 8-bit data for each color) of, for example, red (R), green (G), and blue (B) to the image processing device 70. Meanwhile, the image processing device 70 applies the predetermined image processing, such as shading correction, positional deviation correction, lightness/color space conversion, gamma correction, outline removal, or color/movement edit, to the image data which is transmitted from the image input device 60. Further, in the image processing device 70, the image signal subjected to the image processing is changed into each image signal of the four colors (Y, M, C, K), and thereafter transmitted to the exposure device 13. Further, in the image processing device 40, the image signals for the two special colors (S1, S2) are also generated.

Operations in its Entirety and Principal Sections of Image Forming Apparatus

Hereinafter, the basic image formation operation performed by the image forming apparatus 1 will be described.

Here first, a description will be given of a pattern of an image formation operation by which a full-color image is formed by combination of the toner images of four colors (Y, M, C, K) using all the four image creating devices 10 (Y, M, C, K).

When receiving command information of a request of an image formation operation (printing), the image forming apparatus 1 activates the four image creating devices 10 (Y, M, C, K), the intermediate transfer device 20, the secondary transfer device 30, the fixing device 40, and the like.

Then, in each of the image creating devices 10 (Y, M, C, K), first by rotating each photoconductor drum 11 in a direction indicated by the arrow A, each charging device 12 charges the surface of each photoconductor drum 11 with a desired polarity (a negative polarity in the exemplary embodiment) and at an electric potential. Subsequently, each exposure device 13 performs exposure on the surface of the charged photoconductor drum 11 by emitting light LB on the basis of the image signal that can be obtained by converting the image information, which is input to the image forming apparatus 1, into each color component (Y, M, C, K), thereby forming an electrostatic latent image of each of the color components having electric potential differences desired for the surface.

Next, each developing device 14 (Y, M, C, K) supplies the toner with each corresponding color (Y, M, C, K), which is charged with a desired polarity (negative polarity), from the developing rollers 141 and 142 to the electrostatic latent image of each color component formed by the photoconductor drum 11, and electrostatically adheres the toner onto the image. By performing development in such a manner, the electrostatic latent image of each color component formed by each photoconductor drum 11 is developed as a toner image of each of the four colors (Y, M, C, K) by using the toner with the corresponding color.

Subsequently, when respective color toner images formed on the photoconductor drums 11 of the image creating devices 10 (Y, M, C, K) are transported to the primary transfer position, the primary transfer device 15 primarily transfers the color toner images onto the intermediate transfer belt 21, which is rotated in the direction indicated by the arrow B of the intermediate transfer device 20, such that the images are sequentially superposed upon one another.

Further, in each image creating device 10 after termination of the primary transfer, the uncleaned-state charging device 16 recharges attachments such as the toner remaining on the surface of the photoconductor drum 11 subjected to the primary transfer, thereafter the drum cleaning device 17 removes the recharged attachments by scraping them off so as to clean the surface of the photoconductor drum 11, and the charge remover 18 finally removes the charge of the cleaned surface of the photoconductor drum 11. Thereby, each image creating device 10 is set to be able to perform the next image creating operation.

Subsequently, the intermediate transfer device 20 holds the toner image, which is primarily transferred by the rotation of the intermediate transfer belt 21, and transports the image to the secondary transfer position. Meanwhile, the sheet feeding device 50 sends the desired printing paper 5 for the image creating operation to the sheet feeding transport path. In the sheet feeding transport path, the pair of paper transport rollers 57 as registration rollers supplies the printing paper 5 by sending the paper to the secondary transfer position at the transfer timing.

At the secondary transfer position, the secondary transfer device 30 collectively secondarily transfers the toner images, which are formed on the intermediate transfer belt 21, onto the printing paper 5. Further, in the intermediate transfer device 20 after termination of the secondary transfer, the belt cleaning device 28 removes attachments such as toner remaining on the surface of the intermediate transfer belt 21 after the secondary transfer, thereby cleaning the surface.

Subsequently, the printing paper 5, onto which the toner images are secondarily transferred, is released from the secondary transfer belt 31 by the intermediate transfer belt 21, and is thereafter transported to the fixing device 40 by the transporting device 58. The fixing device 40 guides and passes the printing paper 5 subjected to the secondary transfer through the contact portion between the heating rotating member 42 and the pressing rotating member 43, which are rotating, so as to perform a desired fixing process (heating and pressing), thereby fixing unfixed toner images onto the paper 5. Finally, the completely fixed printing paper 5 is discharged to, for example, a discharging containing section, which is not shown in the drawing, formed outside the casing 1*a* by the pair of paper discharging rollers 59 at the time of the image formation operation for forming an image on one surface of the paper.

Through the operation described hitherto, the printing paper 5, on which the full-color image is formed by combination of the four-color toner images, is discharged.

Next, in the image forming apparatus 1, for example a description will be given of an operation by which special-color toner images are additionally formed by developers of the special colors S1 and S2 when the normal image formation is performed.

In this case, first, in each of the image creating devices 10S1 and 10S2, the image creating operation, which is the same as that of the above mentioned image creating device 10 (F, M, C, K) is performed. Thereby, the special-color toner images (S1, S2) are formed on the photoconductor drums 11 of the image creating devices 10S1 and 10S2, respectively. Subsequently, the respective special-color toner images, which are formed by the image creating devices 10S1 and 10S2, are primarily transferred onto the intermediate transfer belt 21 of the intermediate transfer device 20 in a similar manner to the case of image formation operations of the above-mentioned four-color toner images, and are secondarily transferred onto the printing paper 5 (together with the other toner images) from the intermediate transfer belt 21 by the secondary transfer device 30. Finally, the printing paper 5, onto which the special-color toner images and the other toner images are secondarily transferred, undergoes the fixing process in the fixing device 40, and thereafter discharged outside the casing 1*a*.

Through the operation described hitherto, the printing paper 5, on which the two special-color toner images are superposed upon the whole area or a part of the above-mentioned full-color image formed by combination of the four-color toner images, are discharged.

Otherwise, when the image forming apparatus 1 is a color copier equipped with the image input device 60, the basic image formation operation is performed as follows.

That is, in this case, the original document 6 is set on the image input device 60, command information of the request for the image formation operation (copy) is received, then the original image of the original document 6 is read in the image input device 60, thereafter information of the read original image is generated as an image signal through the above-mentioned image processing in the image processing device 70, and subsequently the image signal is transmitted to the exposure devices 13 of the respective image creating devices 10 (S1, S2, Y, M, C, K). Thereby, in the respective image creating devices 10, the toner image and the electrostatic latent image based on the image information of the original document 6 are formed respectively. Thereafter, an operation, which is the same as the above-mentioned image formation operation (printing), is performed, and finally an image generated from the toner image is formed on the printing paper 5 and output.

Toners Used in Image Creating Devices 10S1 and 10S2

In this exemplary embodiment, the toners used in the image creating devices 10S1 and 1052 employ metallic color toners as examples of particular toners, each of which has at least one of the different particle diameter and shape, and the toners which are used in the image creating devices 10 (Y, M, C, K) of yellow (Y), magenta (M), cyan (C), and black (K). For example, a gold color toner is used in the image creating device 10S1, and a silver color toner is used in the image creating device 10S2. Each toner of yellow (Y), magenta (M), cyan (C), and black (K) is formed in, for example, a shape similar to a spherical shape of which the number of the average particle diameter is in the range of about 5 to 6 μm. However, it is not necessary for the respective toners of yellow (Y), magenta (M), cyan (C), and black (K) to have shapes similar to spherical shapes, and the toners may be formed in different shapes like the grinded toner.

Meanwhile, the metallic color toners, which are formed of the gold color toner and the silver color toner, are formed in scale shapes (disc shapes) or spherical shapes by compounding for example pigments (fine particles) of which the particle diameters are relatively large like the metal aluminum powder in addition to the compounding agent, the colorant, and the synthetic resin such as acryl or styrene constituting the toners. The number average particle diameter thereof is in the range of, for example, about 10 to 40 μm relatively larger than that of the normal toner. In addition, the metallic color toner is not limited to the pigment (fine particles) such as the metal aluminum powder, and may employ a toner, in which a scale-like pigment formed by coating a chip-like inorganic crystalline substrate with a thin film made of titanium oxide is compounded with a colorant, or a toner in which scale-like chips made of metal are compounded. In this exemplary embodiment, the metallic color toner is formed in a scale shape (disc shape), and employs a toner of which the number average particle diameter is in the range of as relatively large as for example, about 10 to 40 μm.

In one embodiment, the pigment may include metal. For example, the pigment may include aluminum.

Configuration of Retransporting Device

The image forming apparatus 1 configured as described above is able to perform the processes of transferring and fixing the toner image onto the printing paper 5 as an example of the printing target member divisionally, plural times. Hence, the image forming apparatus 1 has a retransporting device 80 that transports the printing paper 5 as an example of the printing target member, on which the toner image is formed by the image creating device 10 (Y, M, C, K) and onto which the toner image is secondarily transferred by the intermediate transfer device 20 and the unfixed toner image is fixed by the fixing device 40, again to the secondary transfer position of the intermediate transfer device 20. A transport path changing section 81 is disposed downstream of the fixing device 40 so as to change the transport path of the printing paper 5 to the pair of paper discharging rollers 59 and the retransporting device 80. The retransporting device 80 is constituted of a transport guide, which is not shown in the drawing, and pairs of transport rollers 82 to 88 that transport the printing paper 5, on which the fixing process is performed by the fixing device 40, such that the printing paper 5 reaches the secondary transfer position on the intermediate transfer belt 21 of the intermediate transfer device 20 in a state where the surface of the paper is the same. The leading end portion thereof is connected to the paper transport path.

Configuration of Fixing Device

Figure 3:
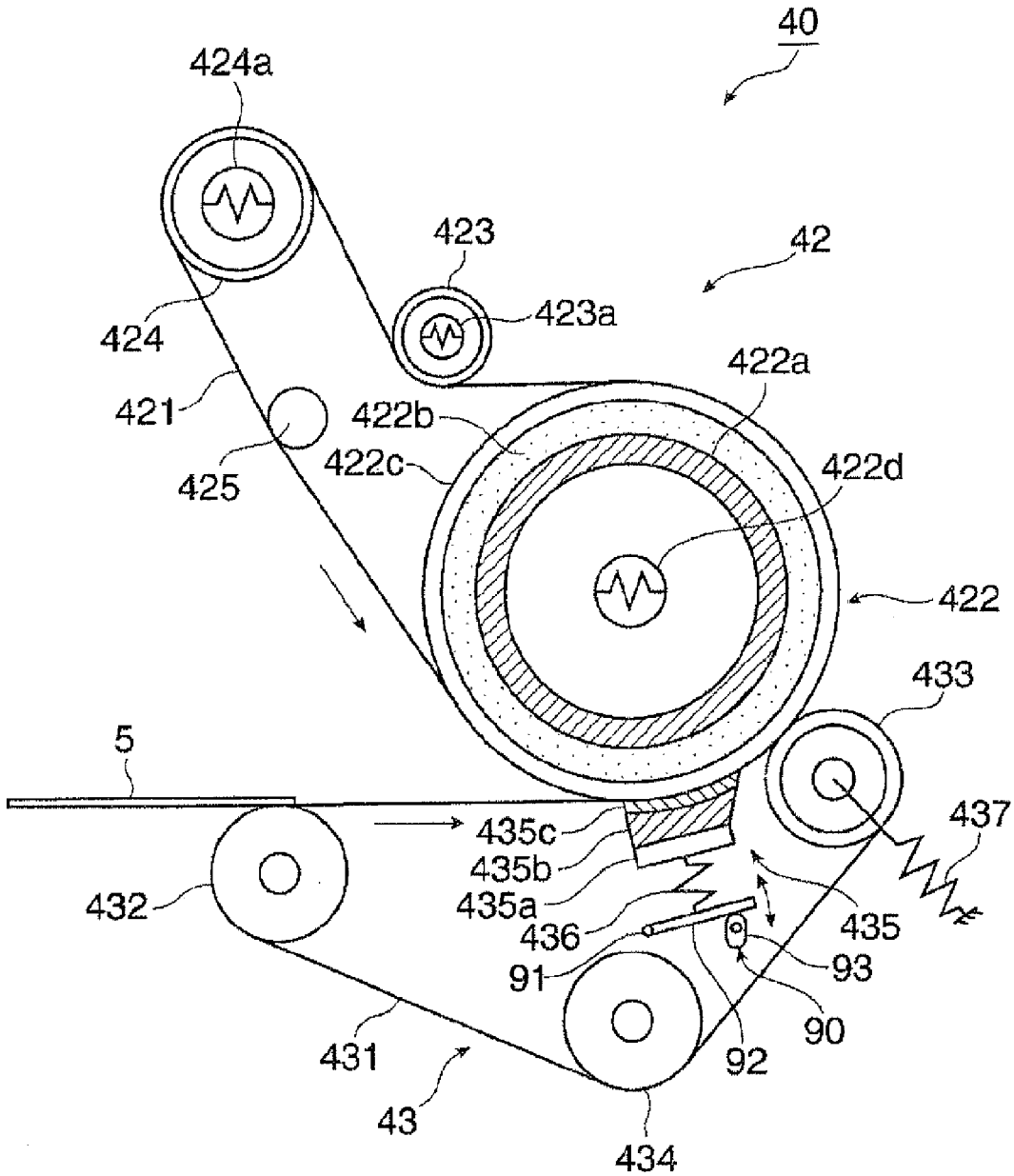
FIG. 3 is a cross-sectional configuration diagram illustrating a fixing device.

The fixing device 40 includes, as shown in FIG. 3: a heating rotating member 42 that has a heating belt which is rotated inside the casing 41 in a direction indicated by the arrow and heats by a heating section such that the surface temperature is held at a predetermined temperature; and a pressing rotating member 43 that has a pressing belt which is driven to be rotatable in contact with the heating rotating member 42 with a predetermined pressure in the substantial axial direction thereof.

The heating rotating member 42 principally includes: a heating belt 421 that is rotated in the direction indicated by the arrow while passing through the pressed contact portion of the pressing rotating member 43 at which the belt comes into contact with a predetermined pressure; and plural supporting rollers 422 to 425 that hold and rotatably support the heating belt 421 from the inside and the outside thereof in a desired state. The heating belt 421 is formed in an endless belt shape by coating the surface of the base material layer made of a polyimide resin or the like with a release layer made of a tetra fluoro ethylene/perfluoro alkyl vinyl ether copolymer resin (PFA) or the like. The supporting roller 422 functions as a heating roller. The heating roller 422 includes a metallic core 422*a*, an elastic layer 422*b* with which the outer circumference of the core 422*a* is coated and which has heat resistance, and a release layer 422*c* that is made from PFA or the like with which the surface of the elastic layer 422*b* is coated. Further, a halogen lamp 422*d* as a heating source is disposed in the heating roller 422, a halogen lamp 423*a* as a heating source is disposed in the supporting roller 423 as an external heating roller, and a halogen lamp 424*a* as a heating source is disposed in the supporting roller 424 as an external heating roller.

The pressing rotating member 43 principally includes: a pressure belt 431 that is rotated in a direction indicated by the arrow while passing the pressed contact portion of the heating rotating member 42 at which the belt comes into contact with a predetermined pressure; plural supporting rollers 432 to 434 that hold and rotatably support the pressure belt 431 from the inside thereof in a desired state; and a pushing member 435 that urges the pressure belt 431 against the heating roller 422 so as to bring the belt into contact with the roller. The pressure belt 431 is made of the same material as the heating belt 421, and is formed in an endless belt shape. The pushing member 435 includes: a base material layer 435*a* that is made of a metal, a synthetic resin, or the like; an elastic layer 435*b* that is laminated on the surface of the base material layer 435*a*; and a low frictional layer 435*c* that is laminated on the surface of the elastic layer 435*b*. The pushing member 435 is urged against and brought into contact with the surface of the heating roller 422 by a compression coil spring 436 with a predetermined load with the fixing belt 431 interposed therebetween. Further, the supporting roller 433, which functions as a pressing roller, is urged against the surface of the heating roller 422 and brought into contact with the surface of the heating roller 422 by the pushing section 437, which is formed of a compression coil spring or the like, with a predetermined load with the fixing belt 431 interposed therebetween. The urging force, by which the pressure belt 431 is urged against and brought into contact with the heating roller 422, is set to a pressure of, for example, about 15 to 25 kg/cm$^2$ at the time of fixing the normal YMCK toner.

The pressing rotating member 43 has a pressure adjusting mechanism 90 that adjusts the pressure by which the pushing member 435 is urged against and brought into contact with the heating roller 422. The pressure adjusting mechanism 90 includes: a lever 92 that supports the lower end portion of the compression coil spring 436, which urges and brings the pushing member 435 against and into contact with the heating roller 422, and obliquely moves with respect to a fulcrum 91 set as a center thereof; and an eccentric cam 93 that vertically moves the leading end portion of the lever 92. By rotating the eccentric cam 93 through a driving motor which is not shown in the drawing, the leading end portion of the lever 92 is vertically moved, and the length of the compressed compression coil spring 436, of which the end portion is supported on the middle portion of the lever 92, is changed. In such a manner, the pressure, by which the pushing member 435 is urged against and brought into contact with the heating roller 422, is adjusted. It should be noted that the pressure adjusting mechanism 90 may not only changes the length of the compressed compression coil spring 436 but also may move the entirety of the pressing rotating member 43 in directions in which it is urged against and separated from the heating rotating member 42. Further, the pressure adjusting mechanism 90 may adjust the pressure by moving the heating rotating member 42 toward the pressing rotating member 43.

Figure 4:
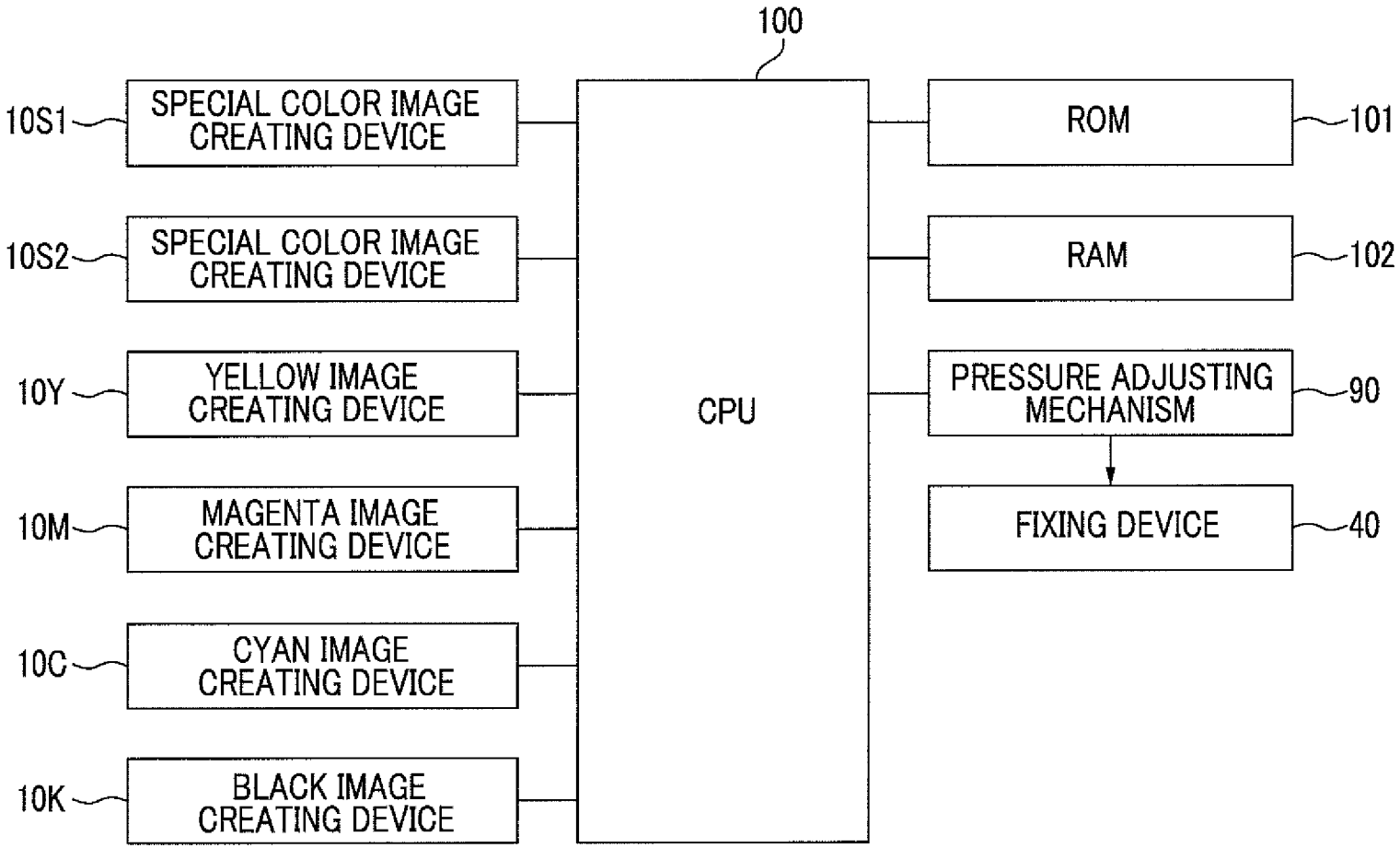
FIG. 4 is a block diagram illustrating a control circuit.

FIG. 4 is a block diagram illustrating a control circuit of the image forming apparatus.

In FIG. 4, the reference numeral 100 indicates a CPU 100 as a control section. The CPU 100 controls the entire image formation operation of the image forming apparatus 1, and controls the fixing pressure of the fixing device 40 through the pressure adjusting mechanism 90. The CPU 100 controls the image formation operation and the fixing pressure of the fixing device 40 while appropriately referring to parameters and the like stored in a RAM 102, on the basis of a program which is stored in a ROM 101 in advance.

The reference numerals 10S1, 10S2, 10Y, 10M, 10C, and 10K indicates the respective image creating devices of the special colors S1 and S2, yellow (Y), magenta (M), cyan (C), and black (K).

Further, the reference numeral 90 indicates the pressure adjusting mechanism (changing section) that adjusts the fixing pressure of the fixing device 40 by controlling the driving motor which rotates the eccentric cam 93 on the basis of the signal transmitted from the CPU 100.

Operation of Characteristic Part of Image Forming Apparatus

Next, a description will be given of, for example, an operation for forming the special-color toner images, which are formed by the developers of the special colors S1 and S2, ahead of the normal image formation, in the image forming apparatus 1. Here, it is assumed that, in one image creating device 10S1 between the image creating devices 10S1 and 10S2, the toner image with the gold metal color is formed.

In this case, first, the image creating device 10S1 performs the image creating operation which is similar to that of the above-mentioned image creating device 10 (Y, M, C, K). Thereby, the metal-color toner image (S1) as a special color is formed on the photoconductor drum 11 of the image creating device 10S1.

Subsequently, the metal-color toner image, which is formed by the image creating device 10S1, is primarily transferred onto the intermediate transfer belt 21 of the intermediate transfer device 20, and thereafter secondarily transferred onto the printing paper 5 from the intermediate transfer belt 21 by the secondary transfer device 30. Here, the metal-color toner image as a toner image with a special color is transferred as a foundation layer onto the entire surface of the printing paper 5. The printing paper 5, onto which the metal-color toner image is secondarily transferred, is subjected to the fixing process in the fixing device 40.

At that time, as shown in FIG. 3, the CPU 100 changes the length of the compressed compression coil spring 436 by which the pushing member 435 of the fixing device 40 is urged against and brought into contact with the heating roller 422 by the pressure adjusting mechanism 90, thereby controlling the fixing pressure such that the pressure is increased as high as for example about 1.5 to 2 times the pressure in a case of fixing the normal YMCK toner when fixing the printing paper 5 of which the entire surface is subjected to the transfer of the metal-color toner image. Further, not only the fixing pressure but also the fixing temperature may be set to be higher than that of the normal toner.

In one embodiment, a melting point of a particular toner is lower than that of any one of the toners other than the particular toner.

Figure 5A:
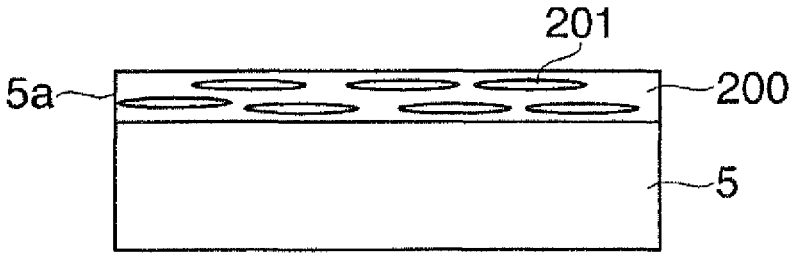
FIGS. 5A and 5B are schematic diagrams illustrating a step of forming a toner image on a printing medium.
Figure 5B:
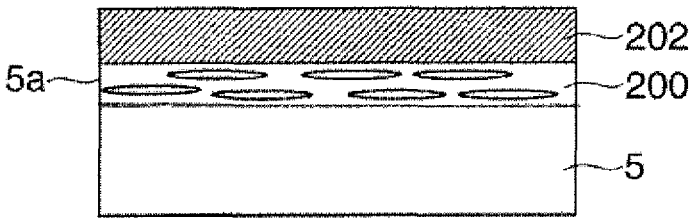

As described above, when the toner image 200 formed by the metallic color toner on the printing paper 5 is fixed, the fixing pressure is controlled to be as high as about 1.5 to 2 times the normal pressure. In such a manner, the metal-color toner including the pigment 201, of which each particle has a particle diameter larger than that of the normal toner and has a planar disc shape, can be fixed with a relatively high pressure in a state where the particles of the pigment 201 each having a planar disc shape in the metallic color toner are aligned in substantially parallel with the surface of the printing paper 5 as shown in FIG. 5A.

Thereafter, the printing paper 5, of which one surface is subjected to the fixing of the foundation layer 5*a* made of the metal-color toner image 200, is transported again by the retransporting device 80 such that the surface of the printing paper 5 located on the intermediate transfer belt 21 side is the same at the secondary transfer position of the intermediate transfer device 20, and the toner image 202 formed of the normal YMCK is secondarily transferred onto the paper from the intermediate transfer belt 21 of the intermediate transfer device 20.

Subsequently, the toner image 202, which is formed of the normal YMCK transferred onto the printing paper 5 onto which the foundation layer 5*a* is fixed, is fixed by the fixing device 40, and discharged outside the casing by the paper discharging roller 59.

At that time, in the fixing device 40, when the toner image 202 of YMCK is fixed, the length of the compressed compression coil spring 436 is changed by the pressure adjusting mechanism 90, whereby the fixing pressure is changed to be set as the normal fixing pressure (for example, about 20 $kg/cm^2$).

As described above, in the exemplary embodiment, at the first image formation, the foundation layer 5*a* using the metallic color toner image 200 is formed on and fixed onto the surface of the printing paper 5. Thereafter, the printing paper 5 is transported to the secondary transfer position of the intermediate transfer device 20 in a state where the surface of the paper is the same, the toner image 202 of the normal YMCK toner is transferred onto the paper, and the fixing operation is performed. At this time, when the metallic color toner image 200 formed at the first image formation is fixed onto the printing paper 5, the fixing pressure of the fixing device 40 is set to be relatively higher than that in the case of fixing the normal toner. In such a manner, it is possible to fix the foundation layer 5*a* generated from the metallic color toner image 200 in a state where the metal-color toner including the pigment 201, of which each particle has a large particle diameter and has a planar disc shape, is aligned such that the particles of the pigment 201 each having a planar disc shape in the metallic color toner are substantially parallel with the surface of the printing paper 5.

Further, at the second image formation, the toner image 202 of the normal YMCK toner is transferred and fixed onto the surface of the printing paper 5 on which the foundation layer 5*a* generated from the metallic color toner image 200 is formed. At this time, when the toner image 202 of the normal YMCK toner is intended to be fixed onto the printing paper 5, the fixing pressure of the fixing device 40 is controlled to be changed to the normal pressure. Thereby, it is possible to inhibit image defects from being caused by the excess of the pressure.

Figure 6A:
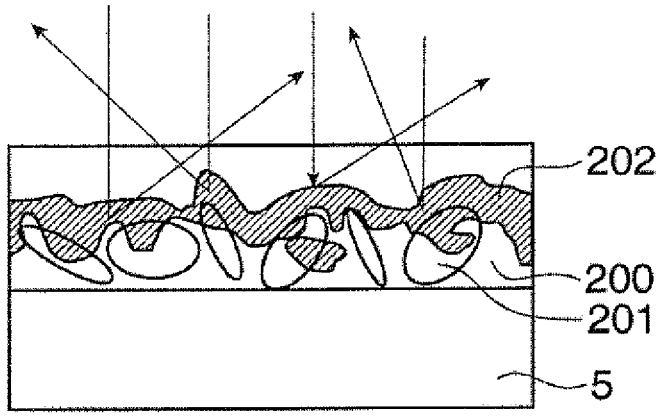
FIGS. 6A and 6B are schematic diagrams illustrating a step of forming a toner image on a printing medium in a comparative example.

FIG. 6A is a schematic diagram illustrating a case where the toner image is formed on the printing paper 5 through a single transferring and fixing step in which the foundation layer 5*a* made of the metallic color toner is formed on the printing paper 5 and the toner image 202 of the normal YMCK toner is successively formed. It should be noted that the fixing pressure of the fixing device is set to a pressure for fixing the toner image 202 of the normal YMCK toner.

In this case, as shown in FIG. 6A, the particles of the pigment 201 of the metallic color toner, each of which is formed in a planar disc shape, are randomly oriented, and thus the surface thereof is uneven. Accordingly, the surface scatters light, and thus the glossiness is lowered. Furthermore, the toner image 202 of the normal YMCK is mixed in the foundation layer 5*a*, and thus the color turbidity or deterioration in chromogenic property occurs.

Figure 6B:
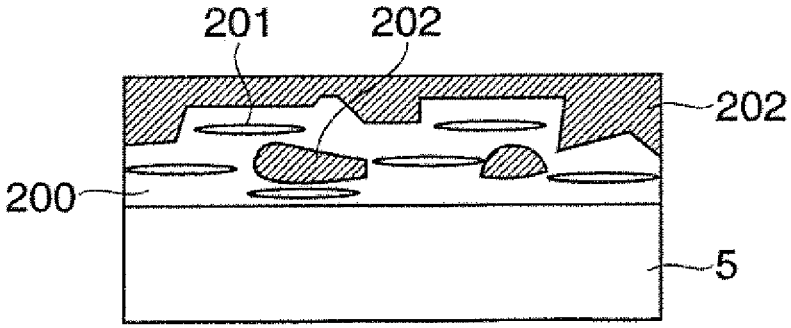

FIG. 6B is a schematic diagram illustrating a case where the toner image is formed on the printing paper 5 through a single transferring and fixing step in which the foundation layer 5*a* made of the metallic color toner is formed on the printing paper 5 and the toner image 202 of the normal YMCK toner is successively formed. It should be noted that the fixing pressure of the fixing device 40 is set to a pressure for fixing the toner image 202 of the normal YMCK toner.

In this case, as shown in FIG. 6B, the particles of the pigment 201 of the metallic color toner, each of which is formed in a planar disc shape, are oriented in parallel with the surface of the printing paper 5. However, some particles of the pigment 201, each of which is formed in a planar disc shape, are mixed in the toner image 202 of the normal YMCK toner, and the toner image 202 of the normal YMCK is mixed in the foundation layer 5*a*. Thus, the color turbidity or deterioration in chromogenic property occurs.

Exemplary Embodiment 2

Figure 7:
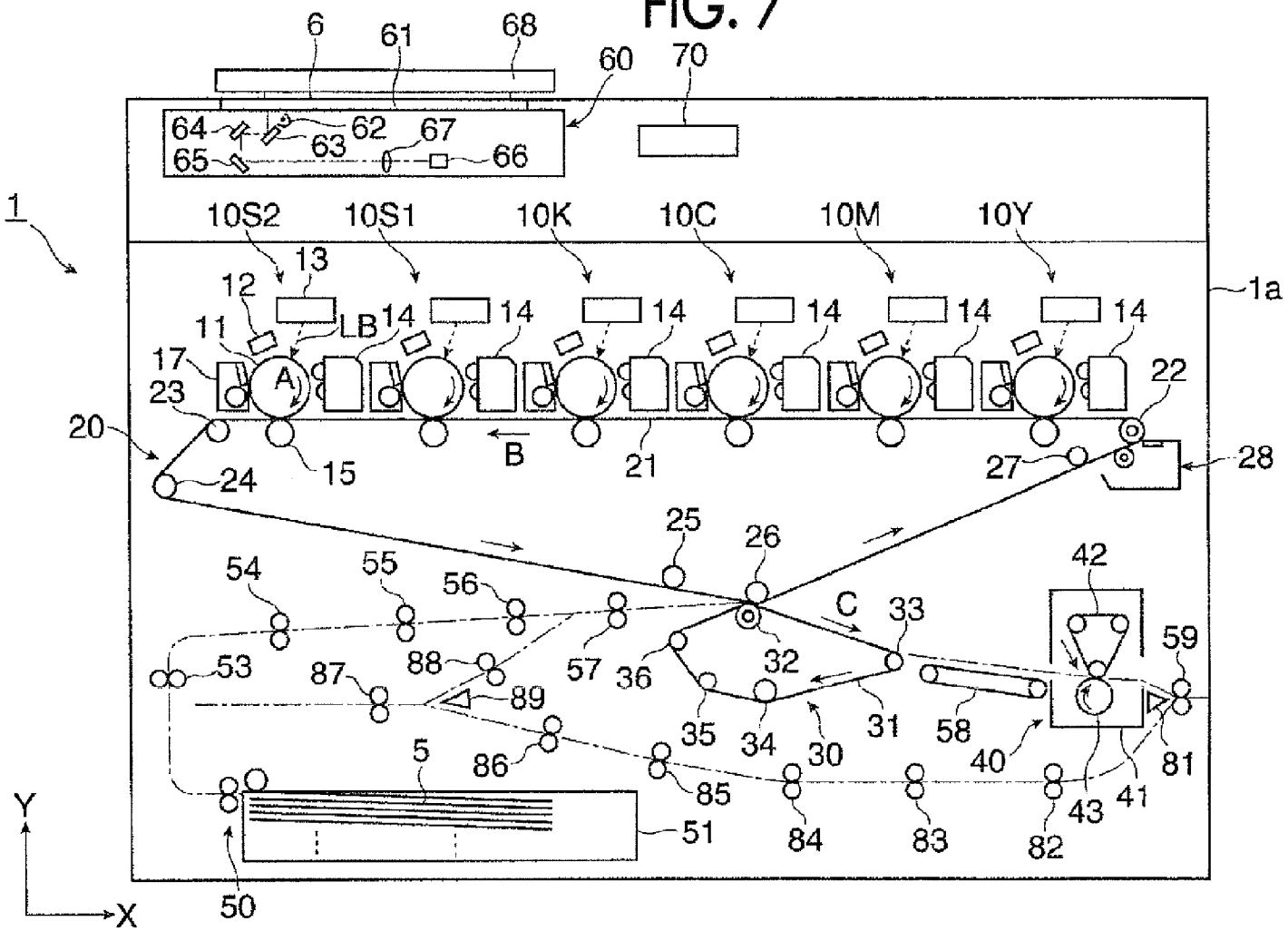
FIG. 7 is an overall configuration diagram illustrating an image forming apparatus according to Exemplary Embodiment 2 of the invention.

FIG. 7 shows a brief overview of the entirety of an image forming apparatus according to Exemplary Embodiment 2.

Configurations and Operations of Principal Sections of Image Forming Apparatus

In Exemplary Embodiment 2, the transport direction of the printing paper 5 is not changed through the curved transport path by the retransporting device 80 that transports the printing paper 5, which passes the fixing device 40, again to the secondary transfer position of the intermediate transfer device 20, but after the printing paper 5, which passes the fixing device 40, is transported first to the downstream side in the transport direction by the pair of paper discharging rollers 59, while the pair of paper discharging rollers 59 holds the tailing end of the printing paper 5, the pair of paper discharging rollers 59 is reversely rotated, and the transport path is changed to the retransporting device 80 by the transport path changing section 81. The retransporting device 80 includes pairs of transport rollers 82 to 88 that transport the printing paper 5, which is subjected to the fixing process by the fixing device 40, again such that the printing paper 5 reaches the secondary transfer position on the intermediate transfer belt 21 of the intermediate transfer device 20 in a state where the surface of the paper is the same; and a transport guide that is not shown in the drawing.

After the pair of transport rollers 87 transports the printing paper 5 first to the downstream side in the transport direction, while the pair of transport rollers 87 holds the tailing end of the printing paper 5, the pair of transport rollers 87 is reversely rotated, and the transport path is changed by the transport path changing section 89 and is linked to the paper transport path through the pair of transport rollers 88 ahead of the pair of paper transport rollers 57.

With such a configuration, it is not necessary to curve the printing paper 5 with a large curvature in the transport path of the retransporting device 80 of the printing paper 5. The foundation layer 5*a* fixed on the surface of the printing paper 5 is the metallic color toner including metal powder. Thus, when the stiffness thereof after the fixing is relatively high and the curvature of the curved portion of the transport path is large, there is a concern about damage to the foundation layer which is fixed on the printing paper 5.

In contrast, in Exemplary Embodiment 2, it is not necessary to provide the curved portion in the transport path of the printing paper 5, and thus it is possible to reduce the concern about damage to the foundation layer 5*a* which is fixed on the printing paper 5.

In addition, the exemplary embodiments described the case of using the belt-to-belt type as the fixing device, but the invention is not limited to this, and both may be constituted of rollers, or combination of rollers and belts may be used.

Further, the exemplary embodiments described the case of using the metallic color toner as the particular toner, but the invention is not limited to this. For example, if at least one of the particle diameter and shape of the toner is different from that of the other toner, it may be possible to use a white toner, a transparent toner, or the like of which each particle has a spherical shape and the particle diameter is in the range of about 10 to 40 μm larger than that of the normal toner.

Further, the exemplary embodiments described the case where the image creating devices 10Y, 10M, 10C, and 10K of yellow (Y), magenta (M), cyan (C), and black (K) as the image forming sections and the image creating devices 10S1 and 10S2 of the special colors S1 and S2 are arranged in line. However, it is apparent that the image creating devices 10Y, 10M, 10C, and 10K of yellow (Y), magenta (M), cyan (C), and black (K) as the image forming sections and the image creating devices 10S1 and 10S2 of the special colors S1 and S2 may be separately provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms a toner image on a printing medium by using a plurality of image creating devices and a plurality of toners including a first set of toners of which at least one of each particle diameter and each particle shape is different from that of a second set of toners, wherein the plurality of image creating devices include (i) a first set of image creating devices and (ii) a second set of image creating devices different from the first set of image creating devices;

a fixing section that fixes the toner image using the first set of toners which is formed on the printing medium by the first set of image creating devices of the image forming section, and, thereafter, that separately fixes the toner image using the second set of toners which is formed on the printing medium by the second set of image creating devices of the image forming section;

a retransporting section that transports the same surface of the printing medium, on which the toner image is fixed by the fixing section after the toner image has been fixed onto the printing medium, to the image forming section again; and a changing section that changes a fixing pressure such that the changing section applies (i) a first pressure at the time of fixing the toner image with the first set of toners, (ii) a second pressure at the time of fixing the toner image using the second set of toners other than the first set of toners, when the toner image is formed on the printing medium by the image forming section and the toner image is fixed by the fixing section a plurality of times, wherein the first and second pressures are different.

2. The image forming apparatus according to claim 1, wherein the fixing pressure of the toner image, in which a particular toner is used, is higher than the fixing pressure of the toner image in which the toners other than the particular toner are used.

3. An image forming apparatus comprising:

an image forming section that forms a toner image on a printing medium by using a plurality of image creating devices and a first set of toners including a particular toner which contains metal pieces, wherein the plurality of image creating devices include (i) a first set of image creating devices and (ii) a second set of image creating devices different from the first set of image creating devices;

a fixing section that fixes the toner image, using the first set of toners, which is formed on the printing medium by the first set of image creating devices of the image forming section and, thereafter, that separately fixes the toner image using a different toner which does not include metal pieces on the printing medium by the second set of image creating devices of the image forming section; and a retransporting section that transports the same surface of the printing medium, on which the toner image is fixed by the fixing section after the toner image has been fixed onto the printing medium, to the image forming section again , wherein after the image forming and fixing performed using the plurality of toners including the particular toner which contains the metal pieces, the image forming section and the fixing section perform the image forming and fixing using a toner which does not contain the metal pieces so that the fixing using the toner with metal pieces is fixed separately from the toner which does not include metal pieces, and a fixing pressure of the fixing performed using the particular toner which contains the metal pieces is higher than a fixing pressure of the fixing performed using the toner which does not contain the metal pieces.

4. An image forming method comprising:

forming a toner image on a printing medium by using a plurality of image creating devices and a first set of toners including a first set of toners of which at least one of each particle diameter and each particle shape is different from that of a second set of toners, wherein the plurality of image creating devices include (i) a first set of image creating devices and (ii) a second set of image creating devices different from the first set of image creating devices;

fixing the toner image using the first set of toners which is formed on the printing medium in the forming of the toner image;

after the fixing the toner image using the first set of toners, making the printing medium, on which the toner image is fixed in the fixing of the toner image, subjected to the forming of the toner image again in a state where a surface of the printing medium is the same;

after the fixing the toner image using the first set of toners and after the printing medium is again subjected to the forming of the toner image, fixing the toner image using the second set of toners which is formed on the printing medium in the forming of the toner image; and changing a fixing pressure such that the changing section applies (i) a first pressure at the time of fixing the toner image with the first set of toners , (ii) a second pressure at the time of fixing the toner image using the second set of toners other than the first set of toners, when the toner image is formed on the printing medium by an image forming section and the toner image is fixed by a fixing section a plurality of times, wherein the first and second pressures are different, when the toner image is formed on the printing medium in the forming of the toner image and the toner image is fixed in the fixing of the toner image a plurality of times, wherein the first and second pressures are different.

5. An image forming method comprising:

forming a toner image on a printing medium by using a plurality of image creating devices and a first set of toners including a particular toner which contains metal pieces, wherein the plurality of image creating devices include (i) a first set of image creating devices and (ii) a second set of image creating devices different from the first set of image creating devices;

fixing the toner image using the first set of toners which is formed on the printing medium in the forming of the toner image; and after the fixing the toner image using the first set of toners, making the printing medium, on which the toner image is fixed in the fixing of the toner image, subjected to the forming of the toner image again in a state where a surface of the printing medium is the same, after the fixing the toner image using the first set of toners and after the printing medium is again subjected to the forming of the toner image, fixing the toner image using a toner which does not include metal pieces on the printing medium by the second set of image creating devices, wherein after the image forming and fixing performed using the plurality of toners including the particular toner which contains the metal pieces, the image is formed and fixed using the toner which does not contain the metal pieces so that the fixing using the toner with metal pieces is fixed separately from the toner which does not include metal pieces, and a fixing pressure of the fixing performed using the particular toner which contains the metal pieces is higher than a fixing pressure of the fixing performed using the toner which does not contain the metal pieces.

6. An image forming apparatus comprising:

an image forming section that forms a toner image on a printing medium by using a first set of toners including a particular toner containing pigment; and a fixing section that fixes, using the first set of toners, the toner image which is formed on the printing medium by the image forming section, and thereafter, that separately fixes the toner image using a toner different from the first set of toners on the printing medium, wherein a first predetermined fixing condition under which the toner image is fixed using the particular toner is different from a second predetermined fixing condition under which the toner image is fixed using toners other than the particular toner so that the fixing using the particular toner is fixed on the same portion of the printing medium separately from when the toner that is different from the first set of toners is fixed to the printing medium.

7. The image forming apparatus according to claim 6, wherein a fixing temperature is higher, a fixing pressure is higher, or a fixing time is longer when the toner image is fixed using the particular toner than when the toner image is fixed using only a toner other than the particular toner.

8. The image forming apparatus according to claim 6, wherein a melting point of the particular toner is lower than that of any one of the toners other than the particular toner.

9. The image forming apparatus according to claim 6, wherein the pigment comprises metal.

10. The image forming apparatus according to claim 6, wherein the pigment comprises aluminum.

* * * * *